US010697121B2

(12) United States Patent
Rao et al.

(10) Patent No.: US 10,697,121 B2
(45) Date of Patent: Jun. 30, 2020

(54) PAPERMAKING PROCESS OF INCREASING ASH CONTENT OF A PAPER PRODUCT AND A PAPER PRODUCT OBTAINED BY THE SAME

(71) Applicant: Ecolab USA Inc., St. Paul, MN (US)

(72) Inventors: Qinglong Rao, Shanghai (CN); Yulin Zhao, Shanghai (CN); Weiguo Cheng, Naperville, IL (US); Stephen B. Ashton, Saint Charles, IL (US); Aleksandar Todorovic, Helsinki (FI); Alan Smith, Sandbach (GB)

(73) Assignee: ECOLAB USA INC., St. Paul, MN (US)

( * ) Notice: Subject to any disclaimer, the term of this patent is extended or adjusted under 35 U.S.C. 154(b) by 180 days.

(21) Appl. No.: 15/531,211

(22) PCT Filed: Oct. 27, 2015

(86) PCT No.: PCT/CN2015/092948
§ 371 (c)(1),
(2) Date: May 26, 2017

(87) PCT Pub. No.: WO2016/082642
PCT Pub. Date: Jun. 2, 2016

(65) Prior Publication Data

US 2017/0328004 A1 Nov. 16, 2017

(30) Foreign Application Priority Data

Nov. 26, 2014 (CN) ..... 2014 1 0691237

(51) Int. Cl.
*D21H 17/37* (2006.01)
*D21H 17/67* (2006.01)
(Continued)

(52) U.S. Cl.
CPC ..... *D21H 17/37* (2013.01); *D21H 17/375* (2013.01); *D21H 17/44* (2013.01); *D21H 17/45* (2013.01);
(Continued)

(58) Field of Classification Search
None
See application file for complete search history.

(56) References Cited

U.S. PATENT DOCUMENTS 5,185,062 A 2/1993 Begala
5,266,164 A 11/1993 Novak et al.
(Continued)

FOREIGN PATENT DOCUMENTS

CN 101736656 A 6/2010
CN 101802304 A 8/2010
(Continued)

OTHER PUBLICATIONS

Smook, Gary A., Handbook for Pulp and Paper Technologists, 2nd ed, Angus Wilde Publications, 1992, pp. 220-225. (Year: 1992).*
(Continued)

*Primary Examiner* — Dennis R Cordray
(74) *Attorney, Agent, or Firm* — Eric D. Babych; Barnes & Thornburg LLP

(57) ABSTRACT

A process for flocculating filler particles in water is provided. The process comprises adding a flocculant to a mixture comprising filler particles and water, wherein the flocculant has a reduced specific viscosity ("RSV") of from about 5 dL/g to about 16 dL/g, a viscosity average molecular weight of from about 1,200,000 to about 7,500,000, and a cationic charge of from about 5 mol % to about 50 mol %. Flocs formed by flocculation of the filler particles and the flocculant have a median particle size of from about 10 μm to about 150 μm. The filler is not precipitated calcium
(Continued)

carbonate alone. The flocs provided by the process are useful in increasing ash content of a paper product.

14 Claims, 2 Drawing Sheets

(51) Int. Cl.
*D21H 17/44* (2006.01)
*D21H 21/06* (2006.01)
*D21H 17/45* (2006.01)
*D21H 21/10* (2006.01)

(52) U.S. Cl.
CPC ..... *D21H 17/455* (2013.01); *D21H 17/67* (2013.01); *D21H 21/06* (2013.01); *D21H 21/10* (2013.01)

(56) References Cited

U.S. PATENT DOCUMENTS 5,458,679 A * 10/1995 Fairchild ..... C04B 35/6365 106/400
5,777,086 A * 7/1998 Klyosov ..... C07G 1/00 530/500
5,993,670 A * 11/1999 Knauer ..... B01F 5/0453 210/136
6,238,521 B1 5/2001 Shing et al.
8,088,213 B2 1/2012 Cheng et al.
8,172,983 B2 * 5/2012 Cheng ..... D21H 17/67 162/168.3
2008/0035293 A1 * 2/2008 Ahlgren ..... D21H 17/69 162/181.7
2009/0065152 A1 3/2009 Cheng et al.
2009/0065162 A1 3/2009 Cheng et al.
2009/0267258 A1 * 10/2009 Cheng ..... D21H 17/67 264/118
2012/0199304 A1 * 8/2012 Cheng ..... D21H 17/45 162/164.6
2013/0059949 A1 * 3/2013 Cheng ..... D21H 17/67 524/53
2013/0299110 A1 * 11/2013 Zhao ..... D21H 17/375 162/164.6

FOREIGN PATENT DOCUMENTS

CN 101952512 A 1/2011
CN 103038419 A 4/2013
CN 103966895 A 8/2014
CN 104053836 A 9/2014
DE 3901292 A1 7/1990
DE 4029824 A1 3/1992
EP 1297039 A1 4/2003
JP 2004-100119 A 4/2004
WO WO 02/02662 A1 1/2002

OTHER PUBLICATIONS

European Patent Office, Extended European Search Report in European Patent Application No. 15862741.4, 13 pp. (dated Mar. 29, 2018).
State Intellectual Property Office of the P.R. China, International Search Report in International Patent Application No. PCT/CN2015/092948, dated Jan. 15, 2016, 5 pp.
State Intellectual Property Office of the P.R. China, International Search Report in International Patent Application No. PCT/CN2015/092948, dated Jan. 15, 2016, 4 pp.

* cited by examiner

PAPERMAKING PROCESS OF INCREASING ASH CONTENT OF A PAPER PRODUCT AND A PAPER PRODUCT OBTAINED BY THE SAME

CROSS-REFERENCE TO RELATED APPLICATIONS

This application is a national phase application of International Patent Application No. PCT/CN2015/092948, filed Oct. 27, 2015, which claims priority to Chinese Patent Application No. 201410691237.9, filed Nov. 26, 2014, both disclosures of which are incorporated by reference herein in their entireties.

TECHNICAL FIELD

The application relates to, but is not limited to, the field of a papermaking process of increasing ash content of a paper product and the paper product obtained by the same.

BACKGROUND

The ash content of a paper product, i.e. inorganic substances in the paper product, generally comprises incombustible additives (e.g., papermaking fillers) added during papermaking industry production as well as incombustible substances in pulps. The ash content of a paper product can be measured in accordance with the method recorded in GB/T 742-2008 "Measurement of Ash Content of Papermaking Raw Material, Pulp, Paper and Paper Board" of National Standard of China.

The increase of the specific gravity of ash content of a paper product (especially papermaking fillers) can greatly reduce the papermaking cost.

CN101736656 A discloses a method of papermaking having an increased filler content, comprising the steps of: providing a blend of filler particles, at least one strength additive and cellulose fiber stock, treating the filler particles with a composition of matter, combining the filler particles with the cellulose fiber stock, treating the combination with at least one strength additive, and forming a paper board from the combination, wherein at least 10% of the filler particles are precipitated calcium carbonate and at least 10% of the filler particles are ground calcium carbonate, the cellulose fiber stock comprises a plurality of cellulose fibers and water, and the composition of matter enhances the performance of the strength additive in the paper board.

CN103038419A discloses a method of papermaking having an increased filler content, comprising the steps of: adding a first flocculant to an aqueous dispersion in an amount sufficient to mix uniformly in the dispersion without causing significant flocculation of the filler particles, adding a second flocculant to the dispersion after adding the first flocculant in an amount sufficient to initiate flocculation of the filler particles in the presence of the first flocculant, the second flocculant being of opposite charge to the first flocculant; combining the filler particles with the paper fiber stock; treating the combination with at least one strength additive selected from the group consisting of synthetic strength additives; and forming a paper mat from the combination, the paper fiber stock comprises a plurality of fibers and water, and the initiated flocculation enhances the performance of the strength additive in the paper mat, wherein the strength additive is not starch.

U.S. Pat. No. 8,088,213 B2 discloses a method of preparing a stable dispersion of flocculated filler particles having a specific particle size distribution for use in papermaking processes comprising a) providing an aqueous dispersion of filler particles; b) adding a first flocculating agent to the dispersion in an amount sufficient to mix uniformly in the dispersion without causing significant flocculation of the filler particles, the first flocculating agent being an anionic flocculant and has a reduced specific viscosity (RSV) of at least 10 dL/g, wherein there is no paper fiber present in the dispersion; c) adding a second flocculating agent to the dispersion after adding the first flocculating agent in an amount sufficient to initiate flocculation of the filler particles in the presence of the first flocculating agent, the second flocculating agent being of opposite charge to the first flocculating and being a cationic flocculant; and d) shearing the flocculated dispersion to provide a dispersion of filler flocs having the desired particle size; and e) carrying out steps a) to d) before adding the dispersion of filler flocs to paper fibers.

SUMMARY OF INVENTION

The following is a summary of the subject matter described in detail herein. The summary is not intended to limit the protection scope of claims.

Market still needs such a papermaking process and paper products thereof that can increase ash content of the paper product without losing the quality of the paper product obtained, and meanwhile reduce the production cost of the paper product obtained.

The inventors found that, if the papermaking cost is reduced by merely pursuing the increase of the ash content of the paper product, the quality of the paper product obtained will be influenced. For example, paper dry strength agent has a tendency to coat papermaking filler particles, and thus the efficiency of the dry strength agent will be reduced if more filler particles are added. That is, the more the filler particles exist, the more the dry strength agent coats the filler particles, and thus the less the dry strength agent can be used for combining the cellulose fibers together. Since there is a maximum amount of the dry strength agent that can be added, more filler particles means less effective dry strength agent. For such effect, precipitated calcium carbonate (PCC) is more sensitive than ground calcium carbonate (GCC), since PCC has a higher surface area and thus more PCC will be coated by the dry strength agent than GCC. In addition, the cellulose fibers can only adsorb a limited amount of dry strength agent, which imposes limitation on how much dry strength agent can be used and thereby how much papermaking fillers can be used. The dry strength agent tends to neutralize the charges of anionic fibers/papermaking fillers, and when these charges are excessively neutralized, the adsorption of the dry strength agent is inhibited. Therefore, if it is needed to maintain the strength of the paper product while increasing the ash content of the paper product, a complex and high cost pretreatment is generally required for the fillers.

The inventors found through a large number of experiments that, by adding a flocculant having a particular reduced specific viscosity and molecular weight and carrying a certain amount of cationic charge into filler particles, the particular size distribution of the flocs formed by the flocculation of the filler particles could be controlled, and a larger particle size of filler particle flocs could be formed. In such a way, the filler with fine particles can be prevented from covering the fibers and thus the combination between the fibers will be promoted. Thus, the ash content of the paper product can be not only increased without losing the quality of the paper product obtained, but also the production cost of the paper product obtained can be reduced due to simple operation steps and less types of agents to be used.

The embodiments of the present invention provide a papermaking process of increasing ash content of a paper product and a paper product prepared by the same. In the process, by adding a flocculant having a particular reduced specific viscosity and molecular weight and carrying a certain amount of cationic charge, the size distribution of the flocs formed by the flocculation of the filler particles can be controlled. Thus the process can increase the ash content of the paper product without losing the quality of the paper product obtained, and meanwhile reduce the production cost of the paper product obtained.

Therefore, the embodiments of the present invention provide a papermaking process of increasing ash content of a paper product, comprising:

adding a flocculant to a mixture comprising filler particles and water, wherein the flocculant has a reduced specific viscosity (RSV) in a range of 5 dL/g to 16 dL/g, a molecular weight of greater than or equal to 1,200,000 and less than or equal to 7,500,000, and a cationic charge in a range of 5 mol % to 50 mol %;

whereby a size distribution of a flocs formed by a flocculation of the filler particles and the flocculant has a median particle size in a range of 10 μm to 150 μm;

wherein the filler is not precipitated calcium carbonate alone.

The flocculant may have a RSV in a range of 5 dL/g to 12 dL/g, preferably in a range of 9 dL/g to 11 dL/g.

The flocculant may have a molecular weight in a range of 1,400,000 to 5,000,000, preferably in a range of 3,300,000 to 4,400,000.

The flocculant may have the cationic charge in a range of 20 mol % to 40 mol %.

The median particle size may be in a range of 30 μm to 120 μm, preferably in a range of 40 μm to 90 μm.

A range of a size distribution span of the flocs may be less than 2.

An amount of the flocculant may be in a range of 0.2 kg to 4 kg, preferably in a range of 1 kg to 3 kg, relative to per ton of the filler particles.

The flocculant may be a polymer formed by one or more monomers selected from a group of acrylamide, acryloyloxyethyl trimethyl ammonium chloride, dimethylaminoethyl methacrylate, dimethylaminoethyl acrylate, diethylaminoethyl acrylate, diethylaminoethyl methacrylate, diallyldimethylammonium chloride, and quaternary ammonium salt formed of dimethyl sulfate and methyl chloride or benzyl chloride.

The polymer may be a copolymer or terpolymer formed by two or more of the monomers.

The flocculant may be a copolymer of acrylamide and acryloyloxyethyl trimethyl ammonium chloride, and/or a copolymer of acrylamide and diallyldimethylammonium chloride.

The filler may be one or more materials selected from a group of calcium carbonate, kaolin, titanium dioxide, talcum powder, silica, silicate, aluminium hydroxide, barium sulfate and calcium sulfate; wherein when the filler is calcium carbonate, the filler particles at least may comprise 10 wt % of ground calcium carbonate.

The process may further comprise adding a coagulant before adding the flocculant; the coagulant may be one or more materials selected from a group of alum, polyaluminum chloride, cationic polyacrylamide, polyethyleneimine, cationic starch, cationic guar gum, and polyamide-polyamine.

The process may further comprise adding a particulate flocculant before, during or after adding the flocculant to the mixture comprising the filler particles and water; the particulate flocculant may be one or more materials selected from a group of net-like macromolecule flocculant polymer, chain-like macromolecule flocculant polymer, bentonite and a modified product thereof, silica sol, colloidal silica and colloidal alumina.

The mixture comprising the filler particles and water may be an aqueous dispersion of the filler particles.

The process may further comprise adding an enhancer to the papermaking wet end; the enhancer may be one or more materials selected from a group of starch and a modified substance thereof, chitosan, guar gum, hydroxymethyl cellulose (CMC), polyacrylamide, glyoxal polyacrylamide, formaldehyde resin, polyethyleneimine and polyvinyl alcohol.

The process may further comprise that the flocculant is added with a rotating mixing apparatus having a distribution head rotated by a driver, the distribution head is arranged in a container containing a slurry of the filler particles and has a rotation plane associated with the rotation thereof, and the distribution head has, along a circumference, which surrounds a rotation axis, distributed outlets and mixing blades, wherein the outlets are formed as openings, the mixing blades are formed as strips extending transverse to the rotation plane, having a length equal to at least half of an inner diameter of a slurry pipe.

The flocculant may be delivered to the distribution head and be admixed with the filler slurry through the outlets.

The embodiments of the invention may further provide use of a rotating mixing apparatus in the process of any of the embodiments of the present invention.

The rotating mixing apparatus may have a distribution head rotated by a driver, the distribution head is arranged in a container containing a slurry of the filler particles and has a rotation plane associated with the rotation thereof, and the distribution head has, along a circumference, which surrounds a rotation axis, distributed outlets and mixing blades, wherein the outlets are formed as openings, the mixing blades are formed as strips extending transverse to the rotation plane, having a length equal to at least half of an inner diameter of a slurry pipe.

The embodiments of the present invention may further provide a paper product obtained by the process of any of the embodiments of the present invention.

In the embodiments of the present invention, by adding a flocculant having a particular reduced specific viscosity and molecular weight and carrying a certain amount of cationic charge, the particular size distribution of the flocs formed by the flocculation of the filler particles can be controlled. And thus a larger particle size of the flocs with filler particles. Then the papermaking process of increasing ash content of paper product in any of the embodiments of the present invention can prevent a filler of fine particles from covering the fibers and thus the combination between the fibers is promoted. So the ash content of the paper product obtained could be not only increased without losing the quality of the paper product obtained, but also the production cost of the paper product obtained could be reduced.

Other aspects can be understood after reading and understanding the drawings and the detailed description.

BRIEF DESCRIPTION OF THE DRAWINGS

The drawings are used for further understanding the embodiments of the present invention, and constitute a part of the description, which are used in combination with the following specific examples to explain the embodiments of the present invention, but do not form a limitation to the embodiments of the present invention.

DETAILED DESCRIPTION OF EMBODIMENTS

Figure 1:
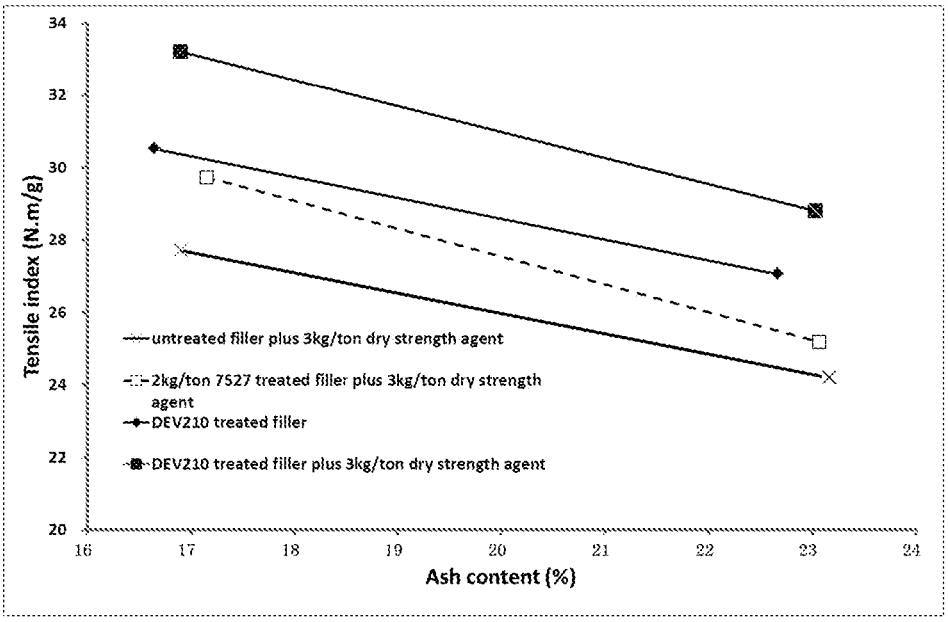
FIG. 1 shows the comparative testing results of tensile index associated with ash content in the paper products obtained from the papermaking process in an embodiment of the present invention and the papermaking process in the relevant techniques.

The embodiments of the present invention are expounded as follows. It should be appreciated that, the embodiments described herein are merely for illustrating and explaining the present invention, but not for limiting the present invention.

The embodiments of the present invention provide a papermaking process of increasing ash content of a paper product, comprising:

adding a flocculant to a mixture comprising filler particles and water, the flocculant has a reduced specific viscosity in a range of 5 dL/g to 16 dL/g, a molecular weight of greater than or equal to 1,200,000 and less than or equal to 7,500,000, and a cationic charge in a range of 5 mol % to 50 mol %;

whereby a size distribution of a flocs formed by the flocculation of the filler particles and the flocculant has a median particle size in a range of 10 μm to 150 μm;

wherein the filler is not precipitated calcium carbonate alone.

Reduced Specific Viscosity

The embodiments of the present invention use reduced specific viscosity to define the flocculant that is suitable for being used in the embodiments of the present invention. As used herein, reduced specific viscosity is represented as "RSV". According to Paul J. Flory, "Principles of Polymer Chemistry", Cornell University Press, Ithaca, N.Y., 1953, Chapter VII, "Determination of Molecular Weights", pages 266-316, in a series of substantially linear and sufficiently solvated polymer homologs, the testing result of "reduced specific viscosity (RSV)" of a dilute polymer solution is an indication of chain length and average molecular weight of the polymer. RSV is measured under given concentration and temperature of a polymer, and is calculated as follows:

$RSV=(t1/t0-1)/c$, wherein, t0 is a drop time of 1M $NaNO_3$ measured by Ubbelohde viscometer in a 30° C. water bath;

t1 is a drop time of the polymer solution measured by Ubbelohde viscometer in a 30° C. water bath;

c is a concentration of the polymer in the solution; the unit of the concentration "c" is (g/dL).

Therefore, the unit of RSV is dL/g. The concentration of the polymer formed in 1.0 M sodium nitrate solution is selected to be 0.045 g/dL. The concentration of the polymer can be obtained by dispersing a certain amount of polymer on an aluminum foil, drying in a 105° C. oven for 2 to 3 hours until constant weight, and dividing the residual solid mass by the mass of a certain amount of polymer solution (polymer+solvent).

For the polymer described herein, a typical inherent error for calculating RSV is within a range of 0.2 dL/g. When two polymer homologs in a series have similar RSV, it is an indication that they have similar molecular weights.

In the embodiments of the present invention, the flocculant can have a reduced specific viscosity in a range of 5 dL/g to 12 dL/g. The flocculant may also have a reduced specific viscosity in a range of 9 dL/g to 11 dL/g. In the foregoing preferable range of reduced specific viscosity, the flocculant may more efficiently make the flocs formed by the flocculation of the filler particles achieve a median particle size required by the examples of the present invention.

Molecular Weight

The "molecular weight" of the flocculant (comprising monomer substance or macromolecule monomer substance) in the embodiments of the present invention refers to viscosity average molecular weight, which is measured by viscometric method. The flocculant of the embodiments of the present invention may have a molecular weight of greater than or equal to 1,200,000 and less than or equal to 7,500,000. Preferably, the flocculant can have a molecular weight in a range of 1,400,000 to 5,000,000, preferably in a range of 3,300,000 to 4,400,000. In the foregoing preferable ranges of molecular weight, the flocculant can more efficiently make the flocs formed by the flocculation of the filler particles achieve a median particle size required by the embodiments of the present invention.

The viscosity average molecular weight in the embodiments of the present invention can be obtained by the viscometric method by use of the formula of:

The relation between RSV and molecular weight: $RSV=b*c+[\eta]=b*c+KM^{\alpha}$, wherein c is the concentration of the polymer (the measurements of c and RSV are as stated above), [η] is intrinsic viscosity of the polymer, M is viscosity average molecular weight, b, K and a are parameters related to the polymer, wherein, $b=-0.0014$, $K=3\times10^{-4}$, and $\alpha=0.6874$. Such formula is established under a low concentration ($c<5$ g/dL).

Cationic Charge

In the embodiments of the present invention, the content of the cationic charge in the flocculant can be obtained by dividing the mole number of the cationic monomer in the flocculant by the total mole number of the monomer and then multiplying by 100%. The flocculant may have a cationic charge in a range of 10 mol % to 50 mol %, preferably the flocculant may have a cationic charge in a range of 20 mol % to 40 mol %.

In the process of the embodiments in the present invention, by adding a flocculant having a reduced specific viscosity and molecular weight within the above preferable ranges and carrying a certain amount of cationic charge, the particular size distribution of the flocs formed by the flocculation of the filler particles could be controlled. In such way, the ash content of the paper product could be not only increased without losing the quality of the paper product obtained in the process, but also the production cost of the paper product obtained could be reduced simultaneously.

Size Distribution

In the embodiments of the present invention, the size distribution of the flocs formed by the flocculation of the filler particles can be characterized by laser light scattering by using Mastersizer Micro from Malvern Instruments Ltd, Southborough, Mass. USA. The analysis is conducted using a polydisperse model and presentation 4PAD. This presentation assumes a refractive index of the filler is 1.60 and a refractive index of water as the continuous phase is 1.33. The distribution is indicated by the volume-weighted median particle size of the flocs, D(V,0.5) and the span of the distribution. The span of the distribution is defined as:

$$\text{Span of the distribution} = \frac{D(V, 0.9) - D(V, 0.1)}{D(V, 0.5)}$$

Here D(V,0.1), D(V,0.5) and D(V,0.9) are defined as the diameters that are equal to or greater than 10%, 50% and 90% by volume of filler particles, respectively.

In the embodiments of the present invention, the size distribution of the flocs formed by the flocculation of the filler particles and the flocculant may have a median particle size in a range of 30 μm to 120 μm. Preferably, the size distribution of the flocs formed by the flocculation of the filler particles and the flocculant may have a median particle size in a range of 40 μm to 90 μm. Moreover, a range of a size distribution span of the flocs may be less than 2. When the size distribution of the flocs formed by the flocculation of the filler particles and the flocculant has a median particle size and a distribution span in the above preferable ranges, it is more conducive to obtain a better quality of paper product while increasing the ash content of paper product.

Flocculant

"Flocculant" refers to a composition which, when added to a liquid, destabilizes colloidal, ground suspended particles in the liquid and aggregates them into flocs. "Flocculation" refers to a modification of changing filler particles into aggregate by treating with a particular flocculant selected based on the size distribution and stability of flocs formed by the flocculant.

The embodiments of the present invention particularly define the reduced specific viscosity and molecular weight of the flocculant and the amount of the cationic charge carried by the flocculant. That is, flocculants that satisfy the foregoing definitions all can achieve the object of the invention in the embodiments of the present invention. Preferably, the flocculant may be a polymer formed by one or more monomers selected from a group of acrylamide, acryloyloxyethyl trimethyl ammonium chloride, dimethylaminoethyl methacrylate, dimethylaminoethyl acrylate, diethylaminoethyl acrylate, diethylaminoethyl methacrylate, diallyldimethylammonium chloride, and quaternary ammonium salt formed of dimethyl sulfate and methyl chloride or benzyl chloride. Preferably, the polymer may be a copolymer or terpolymer formed by two or more of the monomers.

Preferably, the flocculant may be a copolymer of acrylamide and acryloyloxyethyl trimethyl ammonium chloride, and/or a copolymer of acrylamide and diallyldimethylammonium chloride. For example, the flocculant may be DEV210 produced by Nalco Co. In the embodiments of the present invention, the copolymer or terpolymer refers to a copolymer or terpolymer formed by copolymerization of two or three monomers, respectively.

In the embodiments of the present invention, the amount of the flocculant may be in a range of 0.2 kg to 4 kg, preferably in a range of 0.5 kg to 3 kg, further preferably in a range of 1 kg to 3 kg, relative to per ton of the filler particles (generally, which refers to anhydrous filler particles). When the amount of the flocculant is within the preferable range, flocs with a narrower median particle size distribution could be obtained.

Fillers

The fillers used in the embodiments of the present invention may be commercially available fillers known by a person skilled in the art, except that they cannot be precipitated calcium carbonate alone. The fillers generally comprise any inorganic or organic particles or pigments for enhancing the opaqueness or brightness of paper product and reducing the porosity or reducing the cost of paper product. Representative fillers may be selected from a group consisting of calcium carbonate, kaolin, titanium dioxide, talcum powder, silica, silicate, aluminium hydroxide, barium sulfate, calcium sulfate, magnesium hydroxide, and so on. The fillers of the embodiments of present invention further may be one or more materials selected from a group consisting of calcium carbonate, kaolin, titanium dioxide, talcum powder, silica, silicate, aluminium hydroxide, barium sulfate and calcium sulfate.

It is known to a person skilled in the art that calcium carbonate generally comprise ground calcium carbonate (GCC) and precipitated calcium carbonate (PCC). GCC refers to ground calcium carbonate prepared by grinding naturally occurring calcium carbonate rock. PCC refers to synthetic precipitated calcium carbonate. When the fillers are calcium carbonate, the fillers cannot be precipitated calcium carbonate alone, and the filler particles need to comprise at least 10 wt % of ground calcium carbonate. Certainly, the fillers may be 100% ground calcium carbonate.

Coagulant

According to one embodiment of the present invention, the process may further comprise adding coagulant before adding a flocculant, to neutralize anionic charge in part of the filler particles.

The coagulant may be one or more materials selected from a group consisting of alum, polyaluminum chloride, cationic polyacrylamide, polyethyleneimine, cationic starch, cationic guar gum, and polyamide-polyamine. Preferably, the coagulant may be cationic polyacrylamide. When cationic polyacrylamide is chosen as a coagulant, flocculated fillers with a smaller size distribution span could be obtained.

When the coagulant is selected from one or more of the above polymers, the selected polymer may have a number average molecular weight in a range of 200,000 to 2,000,000. The inventors of the present invention unexpectedly found that the addition of a coagulant having a number average molecular weight in a range of 200,000 to 2,000,000 can make the finally treated fillers have a narrower and smaller size distribution.

Preferably, the polymer may further have a number average molecular weight in a range of 400,000 to 1,000,000; preferably, the polymer may further have a number average molecular weight in a range of 400,000 to 600,000.

When the number average molecular weight of the coagulant is within the above preferable ranges, the size distribution span of the finally treated fillers could be narrowed.

The amount of the coagulant may be in a range of 0.01 kg to 5 kg, preferably in a range of 0.5 kg to 2 kg, relative to per ton of the filler particles.

Particulate Flocculant

According to one embodiments of the present invention, the papermaking process of the embodiments of the present invention may further comprise adding a particulate flocculant before, during or after the step of adding the flocculant to the mixture comprising filler particles and water. In the embodiments of the present invention, the mixture comprising the filler particles and water may be an aqueous dispersion of the filler particles.

The particulate flocculant used in the embodiments of the present invention may be a particulate flocculant that is known by a person skilled in the art or conventional. They may be inorganic or organic. The particulate flocculant may be one or more materials selected from a group consisting of net-like macromolecule flocculant polymer or chain-like macromolecule flocculant polymer, bentonite and a modified product thereof, silica sol, colloidal silica and colloidal alumina.

The amount of the particulate flocculant may be selected in the amount range known by a person skilled in the art or conventional. The amount of the particulate flocculant may be in a range of 0.1 kg to 5 kg, preferably in a range of 0.5 kg to 3 kg, relative to per ton of the filler particles.

In addition, the addition of the particulate flocculant and the addition of the aforesaid coagulant do not affect each other, and there is no particular requirement for the order of addition of them.

Enhancer

The papermaking process of the embodiments of the present invention may cooperatively use various papermaking enhancers. The papermaking enhancers may be known or conventional papermaking enhancers.

The papermaking process of the embodiments of the present invention may further comprise adding an enhancer. An enhancer may be added to papermaking wet end.

The enhancer comprises wet strength agent and dry strength agent.

The wet strength agent may be known or conventional wet strength agent. For example, it may be polyamide-polyepichlorohydrin resin, formaldehyde resin, polyethyleneimine, glyoxal polyacrylamide, and so on.

The dry strength agent may be known or conventional dry strength agent, for example, natural dry strength agent or synthetic dry strength agent. Most of the natural dry strength agents or synthetic dry strength agents are hydrophilic macromolecules. These macromolecules are dispersed among fibers for increasing the number of bonds formed among the fibers, thereby achieving the object of improving the strength of the paper product. The dry strength agent generally contains cationic groups linked to the ring of the backbone, such that the bonding force between the polymer and the fibers is increased, thus improving the retention of the polymer.

The common dry strength agents may be selected from a group consisting of natural polymers such as starch and a modified substance thereof, chitosan, guar gum, hydroxymethyl cellulose (CMC); synthetic polymers such as polyacrylamide and polyvinyl alcohol; and other water soluble natural product types of dry strength agent. Starch-modified substances commonly used for papermaking may be classified as five classes according to ionic characteristics: anionic starch, cationic starch, amphoteric and multi-modified starch, nonionic starch and other modified starches. The starch-modified substances commonly used for papermaking also may be classified as acid modified starch, oxidized starch, crosslinking starch, esterified starch and etherified starch according to the preparation method.

In the embodiments of the present invention, the enhancer may be one or more materials selected from a group consisting of chitosan, guar gum, hydroxymethyl cellulose (CMC), starch and a modified substance thereof, polyacrylamide, polyvinyl alcohol, glyoxal polyacrylamide, formaldehyde resin and polyethyleneimine. Preferably, the enhancer may be one or more materials selected from a group consisting of starch and a modified substance thereof, polyacrylamide, polyvinyl alcohol and glyoxal polyacrylamide. Preferably, the enhancer may be starch and a modified substance thereof and/or glyoxal polyacrylamide resin.

Using the papermaking method in the embodiments of the present invention, even in the case of no enhancer being used or the amount of the enhancer being greatly reduced, a general strength requirement for paper product still could be satisfied.

In the case of adding the same amount of enhancer, the strength of paper product obtained by using the process in the embodiments of the present invention is significantly higher than that of the paper product obtained without using the process in the embodiments of the present invention, and the quality of paper product obtained by using the process in the embodiments of the present invention is also better.

A person skilled in the art could judge whether an enhancer needs to be added or not, and could determine the adding amount of the enhancer, according to the actual requirement, for example, according to the requirement on the rigidity of paper product for different kinds of products. The amount of the enhancer may be in a range of 1 kg/ton to 40 kg/ton paper (product).

In the embodiments of the present invention, there is no requirement on the manner of adding the flocculant to the fillers, and it may be added in the manners known by a person skilled in the art or being conventional. Preferably, the flocculant may be added to the fillers via a rotating mixing apparatus. The rotating mixing apparatus may have a distribution head rotated by a driver, the distribution head may be arranged in a container containing a slurry of the filler particles and have a rotation plane associated with the rotation thereof, and the distribution head may have, along a circumference, which surrounds a rotation axis, distributed outlets and mixing blades, wherein the outlets may be formed as openings, the mixing blades may be formed as strips extending transverse to the rotation plane, and have a length equal to at least half of an inner diameter of a slurry pipe.

In the embodiments of the present invention, the flocculant may be delivered to the distribution head for admixing into the filler slurry through the outlets.

The rotating mixing apparatus is specifically described as follows:

The rotating mixing apparatus may mix the flocculant liquid to the filler stream, wherein the distribution head rotated by a driver is arranged in the conduit for circulating the slurry of the filler particles, and has a rotation plane associated with the rotation thereof, and the distribution head has, along a circumference, which surrounds a rotation axis, distributed flocculant outlets and mixing blades, and the distribution head is in communication with the flocculant liquid delivery conduit.

The flocculant liquid is formed by mixing the flocculant and water, and then the flocculant liquid is added to the filler slurry.

There exist cases, when an apparatus for admixing is located, in the direction of the filler slurry stream, downstream of a delivery pump or a centrifuge and which mixes a flocculant liquid and the fillers with each other with good results. However, there exists a noticeable number of cases when the apparatus for admixing is not located, in the direction of the filler slurry stream, downstream of a delivery pump or a centrifuge, the rotating mixing apparatus fails to effect a satisfactory mixing of the flocculant liquid and the filler. In a known apparatus (DE-05 40 29 824), the flocculant outlets are formed as holes or nozzles, and each mixing blade is formed as a journal-like projection, with the dimensions of the mixing blade and the outlet in a direction transverse to the rotational plane being very small in comparison with the width of the sludge stream. In some cases, the admixture of the flocculant liquid to the slurry, which is obtained with the above apparatus is insufficient, i.e., the added flocculant liquid is not sufficiently uniformly distributed in the slurry stream behind the apparatus and is not contained in the slurry in the quantity necessary for a satisfactory flocculation.

The rotating mixing apparatus used in the embodiments of the present invention may achieve a better mixing of the flocculant liquid to the slurry. This is because in the rotating mixing apparatus, the flocculant outlets are formed as openings, such as in form of slot, and the mixing blades are formed as strips, extending transverse to the rotation plane, and having a length equal to at least half of a width of the slurry steam (i.e., the inner diameter of the slurry pipe).

In addition, the structure of the distribution head of the rotating mixing apparatus allows achieving an improved mixing and distribution of the flocculant liquid in the slurry. The flocculant liquid is flowed out of each slot (i.e., the outlets of the flocculant) in the form of a broad strip into which the mixing blade is inserted in a direction opposite to the rotation direction, whereby the mixing blade pulls the flocculant liquid along its edge as foggy strip through the slurry. The flocculant liquid is delivered through the slots as an interrupted torrent into the slurry. Moreover, the slots and strips are arranged one after another in the rotational direction. The dimensioning of the length of the openings and the mixing blades are determined according to the diameter of the filler stream or of the distribution head.

In the rotating mixing apparatus, the openings and the mixing blades may extend both in the directions of the slurry stream and substantially perpendicular to the slurry stream. It is possible in which the rotational axis of the distribution head extends at an angle to the slurry stream. However, the rotation plane of the distribution head extends substantially in a direction of the slurry stream.

In the rotating mixing apparatus, each slot is formed, e.g., of two or more slot sections arranged in a row. It is, however, particularly effective and advantageous when each slot is continuous along its entire length. This prevents clogging and an undesirable high exit velocity of the flocculant liquid.

In the rotating mixing apparatus, each strip-shaped mixing blade may be divided, e.g., along its length, with radial incisions in a comb-like fashion. However, it is particularly effective and advantageous when each strip-shaped mixing blade is continuous along its length. This improves the rigidity of the strip-shaped mixing blades and improves the mixing action.

In the rotating mixing apparatus, the cross-section of each outlet slot may be changed along its length for controlling the amount of the emerging flocculant liquid. It is particularly effective and advantageous when the cross-section of each outlet slot is increased, when viewed along its length, towards the middle. This shape of the outlet slots is used when the slots extend transverse to the stream direction, as in the middle of the slurry pipe, there is more slurry than at both sides. With a uniform slot width, a uniform delivery of the flocculant into the slurry is achieved.

In the rotating mixing apparatus, the slots, which form an outlet for the flocculant liquid, have a width, e.g., of 7-9 mm. The greater is the amount of the flocculant liquid to be delivered in a unit of time, the wider the slots are, and the smaller is the amount of the flocculant liquid to be delivered in a unit of time, the narrower they are.

In the rotating mixing apparatus, it is particularly effective and advantageous when the edge of each strip-shaped mixing blade extends approximately parallel to the inner contour of the slurry pipe, forming a clearance therebetween. The elongate strip-shaped mixing blades extending in a radial direction improve the admixing action. However, a clearance should remain between the mixing blade and the slurry conduit, with the clearance being sufficiently large to permit passing of stone pieces present in the slurry.

In the rotating mixing apparatus, this clearance is particularly important and is large when the strip-shaped mixing blades extend transverse to the stream. When the strip-shaped mixing blades extend transverse to the slurry stream, the clearance preferably is smaller in the direction of the rotational axis than in the direction transverse to the rotational axis.

In the rotating mixing apparatus, it is particularly effective and advantageous when the direction of rotation of the distribution head driver may be changed. In the rotating mixing apparatus, the mixing blade is relatively large or protrudes with respect to the slurry pipe cross-section, so that a danger of clogging with hard pieces and of accumulation of fibers or threads exists if the distribution head rotates in the same direction for a long time. The rotation in opposite directions prevents such clogging and accumulation.

In the rotating mixing apparatus, one, two and/or more flocculant outlets may be provided, e.g., between two mixing blades. However, it is particularly effective and advantageous when outlet slots and strip-shaped mixing blades alternate in the rotational direction. This also improves the admixing process. Over the distribution head, in the rotational direction, there are provided two or more outlet slots and two or more strip-shaped mixing blades.

In the rotating mixing apparatus, it is further particularly effective and advantageous when the inner cross-section of the slurry pipe, in the region of the distribution head, is similar to the further inner cross-section of the slurry pipe. The rotating mixing apparatus thus eliminates the narrowing of the slurry pipe and an associated with its increase of the flow velocity of the slurry. The distribution head already forms a greater narrowing of the cross-section available for the slurry.

It is particularly effective and advantageous when the distribution head is formed as a cylindrical tubular section and/or when the outer diameter of the distribution head is equal at least to 0.4 of the inner diameter of the slurry pipe. This simplifies the construction and improves the rigidity of the distribution head, with the shape of the outlet slots and the strip-shaped mixing blades presenting an increased demand to the rigidity of the distribution head.

In the rotating mixing apparatus, it is particularly effective and advantageous when the distribution head passes into a rotatably supported connection tube which extends away from the slurry pipe and which is connected to the driver and with a flocculant liquid delivery conduit, and is further provided with inlet openings and is rotatably supported in a connection chamber into which the flocculant liquid delivery conduit opens. This manner of delivery of the flocculant liquid to a rotatable distribution head permits to insure an increased rigidity of the connection tube and its support with simple means. This becomes possible in the rotating mixing apparatus due to the "stone crushing" cooperation of the strip-shaped mixing blades and the slurry pipe.

In the rotating mixing apparatus, for a satisfactory delivery of the flocculant liquid through the outlet slots, the flow cross-section, which is available for the flocculant liquid, is very important. For example, all of the outlet slots together have a cross-section which is smaller than the preceding flow cross-section of the flocculant liquid. The entire cross-section of the inlet opening is not smaller than the flow cross-section in the delivery conduit and in the connection tube. The flow cross-sections in the distribution head and in the connection tube are similar. The arrangement of the connection tube in a sealed connection chamber enables to optimize the flow cross-section of the flocculant liquid.

In the rotating mixing apparatus, it is particularly effective and advantageous when a check valve is arranged in the flocculant liquid delivery conduit when the flocculant liquid in front of the check valve is not under pressure, e.g., when the flocculant liquid pump does not operate, the slurry can penetrate into the outlet slots. The sealings and the bearings in the connection chamber remain lubricated with the flocculant liquid when the flocculant liquid from the flocculant liquid pump is not under pressure any more.

In the rotating mixing apparatus, it is particularly effective and advantageous when the distribution head is driven with a rotational speed of 700-2,500 revolution/min preferably, 1,000-1,200 revolution/min. At this relatively high rotational speed, a desired improved admixing and distribution of the flocculant liquid in the slurry takes place. At the too low rotational speed, e.g., below 500 revolution/min, the strip or the stream of the flocculant liquid breaks off. However, a big speed requires too high expenses in order to achieve the desired effect. In a known apparatus (DE-05 4029824) of the above-described type, the flocculant is available which is stored in a reservoir. It is further known (DE-05 39 01 292) to add fresh water to a flocculant available in a liquid or powder form to obtain about 1% of a flocculant parent solution. The flocculant parent solution is then mixed, at a filling station, with 4-10 volume parts of make-up water to obtain a flocculant in a form of a so-called commercial solution. This flocculant is added in the amount of 18-20% of the amount of the filler slurry to the slurry, i.e., about 20 parts of the flocculant liquid in a form of flocculant agent is added to 100 parts of filler particles. At that, the flocculant—containing slurry, i.e., the conditioned filler, contains ⅙ of liquid added by admixing of the additionally added flocculant liquid.

For the processing of the flocculant agent, a large amount of water is used, which is expensive. For the processing, in addition to the apparatus for obtaining the parent solution, an apparatus for obtaining the commercial solution is needed, which results in additional expenses associated with the apparatus and in additional expenses associated with the driving of the apparatus. The flocculant and its water are delivered until they mix up with the slurry, and the delivery requires energy, which is costly. The water component of the flocculant must be delivered, together with the slurry, to filter presses, pass through the filter presses and, finally, purified again. Thus, additional increased expenses are associated with the water contained in the flocculant liquid.

The rotating mixing apparatus can eliminate the expenses associated with the use of the flocculant liquid or increase of its water content. By using the rotating mixing apparatus, maximum 3t of the flocculant liquid need to be provided for 100t of filler slurry.

The distribution head of the rotating mixing apparatus permits to eliminate the water component of the flocculant liquid without the elimination of the effectiveness of the flocculant liquid admixed to the slurry. Moreover, the water component of the flocculant liquid can be reduced to a very large extent, so that the expenses associated with this water content are correspondingly eliminated. As less water is necessary, less water need be pumped, and less water need be purified.

The particular shape of the mixing blade of the rotating mixing apparatus breaks the filler slurry particles of the slurry to a great extent, and the resulting broken pieces form open fissures. The particular shape of the flocculant outlets insures that the flocculant liquid takes a shape of a large surface veil which cover the freshly opened fissures so that the mixing of the filler and the flocculant intensifies. The flocculant liquid is already admixed in a finely distributed state so that it is not necessary the additive to further dilute in a large amount of water, i.e., to increase the water component of the flocculant liquid.

Figure 3:
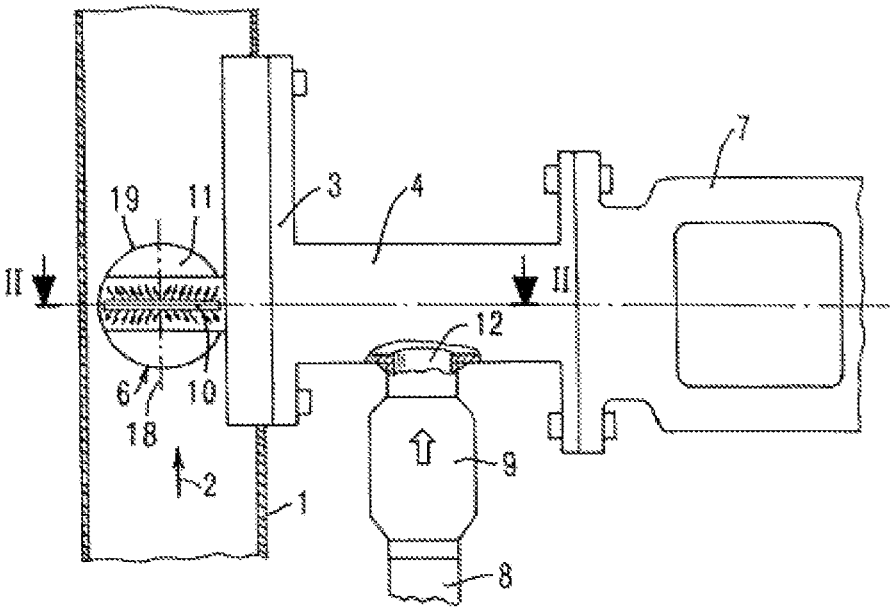
FIG. 3 is a schematic view of the rotating mixing apparatus used in the embodiments of the present invention.
Figure 4:
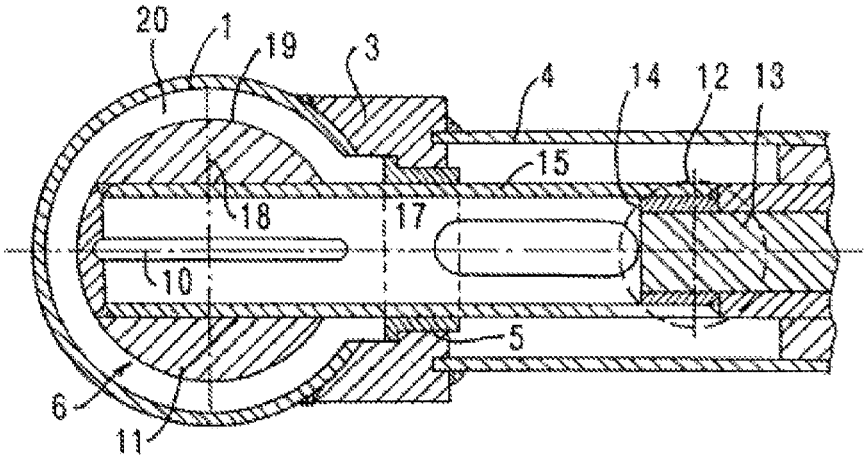
FIG. 4 is a section view of the rotating mixing apparatus used in the embodiments of the present invention.

Refer to FIGS. 3 and 4, the rotating mixing apparatus can be mounted on the filler slurry delivery conduit 1, through which the filler slurry stream flows in a direction of arrow 2. The rotating mixing apparatus can be mounted on the slurry pipe 1 by means of an elongate flange 3 and includes a connection chamber 4 projecting from the flange 3. From the connection chamber 4, a distribution head 6 extends into the slurry pipe 1 and is rotated by a driver 7 provided at the opposite end of the chamber 4, for example, formed as an electromotor. A flocculant liquid conduit 8 opens into the chamber 4, and a check valve 9 is located in the flocculant liquid conduit 8. The distribution head 6 forms outlet slots 10 and provides strip shaped mixing blades 11.

A sleeve 14 supports a connection tube 15 in a shaft extension 12 which extends from the driver 7, and in the end wall of the connection chamber 4, there is provided an axial face seal through which the shaft extension 13 extends. The connection tube 15 has a plurality of elongate entrance openings 17 through which flocculant flows into the connection tube 15 from the connection chamber 4. The connection tube 15 projects into connection chamber 4 through a plain bearing sleeve 5 provided in the flange 3, with the tubular-shaped distribution head 6 forming an integral part of the tube 15. In the distribution head 6 of FIG. 4, the rotational plane 18 is designated with a dash line. Each mixing blade 11 forms an arcuate edge 19 which, in a corresponding position of the blade, limits a slot 20 with respect to the slurry pipe 1, which has a circular cross-section.

The embodiments of the invention further provide an application of the rotating mixing apparatus in the aforesaid processes. The rotating mixing apparatus has a distribution head rotated by a driver, the distribution head is arranged in a container containing a slurry of the filler particles and has a rotation plane associated with the rotation thereof, and the distribution head has, along a circumference, which surrounds a rotation axis, distributed outlets and mixing blades, wherein the outlets are formed as openings, the mixing blades are formed as strips extending transverse to the rotation plane, and have a length equal to at least half of an inner diameter of a slurry pipe.

The flocculant is delivered to the distribution head and is admixed to the filler slurry through the outlets.

The rotating mixing apparatus is as described above, so the embodiments of the present invention need not repeat the detailed description of the rotating mixing apparatus here.

The embodiments of the present invention further provide paper products obtained by the papermaking process of increasing ash content of paper products in the embodiments of the present invention, for example, paper or paper board.

If the above definitions or depictions stated in other places of the present application are not consistent with the common meanings (clear or vague) stated in the dictionary or in the original documents of the present application by citing and combining, the terms in the present application, especially in the claims, should be understood as to be explained according to the definitions or depictions in the present application, rather than to be explained according to general definitions, definitions in the dictionary or definitions by citing and combining.

The embodiments of the present invention are further illustrated in combination with the examples as follows. Unless otherwise particularly explained, the agents and raw materials used in the examples of the invention are commercially available. In different examples, the same agent has the same source.

Example 1

Chemically dispersed GCC filler is mixed with water to form a mixture with a filler content of 18 wt %. 200 mL of the mixture is added to a 500 mL glass beaker, and after being stirred at 800 rpm for 30 seconds, a flocculant, DEV210 (name: a copolymer of acrylamide and acryloyloxyethyl trimethyl ammonium chloride, RSV: 10.78 dL/g, having 20% cationic charge, with a molecular of 5,000,000, available from Nalco (China) Environmental Protection Technology Service Co., LTD), is slowly added. Based on the weight of anhydrous filler, the amount of the flocculant is 2 kg per ton of the filler. After the flocculant is added, the stirring rate is raised to 1500 rpm, sampling after 2 minutes, D(V,0.1), D(V,0.5), D(V,0.9) and a size distribution span of the filler particles are measured by use of a laser particle analyzer (purchased from Malvern Instrument Ltd.). See Table 1 for the experimental results.

Example 2

The method of Example 1 is used, and the difference lies in that a flocculant named 61755 (a copolymer of acrylamide and diallyldimethylammonium chloride, RSV: 5.4 dL/g, having 30% cationic charge, with a molecular of 1,600,000, available from Nalco (China) Environmental Protection Technology Service Co., LTD) is used. See Table 1 for the experimental results.

Comparative Example 1

The method of Example 1 is used, and the difference lies in that Nalco 7527 (a copolymer of acrylamide and diallyldimethylammonium chloride, RSV: 4.3 dL/g, having 30% cationic charge, with a molecular of 1,100,000, available from Nalco (China) Environmental Protection Technology Service Co., LTD) is used instead of DEV210. See Table 1 for the experimental results.

Comparative Example 2

According to the method of Example 20 in U.S. Pat. No. 8,088,213 B2 (controllable filler preflocculation using a dual polymer system), the following agents are used to treat the filler mixture having a filler solid content of 18 wt % formed by mixing 200 mL chemically dispersed ground calcium carbonat (GCC) filler and water in Example 1: 1 kg N7608 (as a coagulant; available from Nalco (China) Environmental Protection Technology Service Co., LTD) per ton of the filler, 2 kg DEV115 (as a first flocculant; available from Nalco (China) Environmental Protection Technology Service Co., LTD) per ton of the filler, and 1.6 kg DEV125 (as a second flocculant; available from Nalco (China) Environmental Protection Technology Service Co., LTD) per ton of the filler. See Table 1 for the experimental results.

Comparative Example 3

The method of Example 1 is used, and the difference lies in that flocculant DEV210 is not added. See Table 1 for the experimental results.

TABLE 1

| Number | Span of Distribution | D (0.1) | D (0.5) Micron | D (0.9) |
|---|---|---|---|---|
| Example 1 | 2.03 | 23.929 | 62.397 | 150.62 |
| Example 2 | 1.53 | 8.629 | 18.799 | 37.394 |
| Comparative Example 1 | 1.394 | 3.459 | 6.933 | 13.123 |
| Comparative Example 2 | 1.946 | 17.441 | 53.262 | 121.064 |
| Comparative Example 3 | 1.553 | 1.302 | 2.642 | 5.404 |

It can be seen from Table 1 that, the fillers treated by the method in the examples of the present invention have a relatively larger median particle size as compared to that in the prior art. Especially, Example 1 of the present invention merely uses one flocculant to achieve a median particle size that is comparable to or even superior than the median particle size obtained by using two flocculants in Comparative Example 2. Although the median particle size of Example 2 is inferior to that of Example 1, it obtains a smaller distribution span.

Example 3

The method is the same as in Example 1, and the difference is treating the filler with a flocculant of copolymer of acrylamide and acryloyloxyethyl trimethyl ammonium chloride having different RSV. See Table 2 for the results.

TABLE 2

| RSV dL/g | Cationic Charge mol % | Span of Distribution | d (0.1) | d (0.5) Micron | d (0.9) |
|---|---|---|---|---|---|
| 5.1 | 30 | 1.351 | 10.047 | 19.726 | 36.706 |
| 5.5 | 30 | 1.24 | 10.813 | 20.096 | 35.738 |
| 7.2 | 30 | 1.517 | 20.657 | 46.342 | 90.954 |
| 9.6 | 30 | 1.54 | 25.417 | 59.502 | 117.047 |
| 11 | 20 | 1.472 | 32.571 | 72.572 | 139.362 |
| 10.78 | 20 | 1.638 | 28.666 | 70.153 | 143.572 |

It can be seen from Table 2 that, the filler treated by the flocculant with a RSV of 5-12 dL/g has a larger median particle size and a size distribution span of less than 2. In addition, the filler treated by the flocculant with a RSV of 9-11 dL/g has a relatively larger median particle size.

Example 4

The method of Example 1 is used, and the difference lies in that a mixture of GCC and PCC having the same mass is used as the filler. See Table 3 for the results.

Example 5

The method of Example 1 is used, and the difference lies in that a mixture of GCC and ultra-fine kaolin (purchased from Zibo Sanhe Chemical Co., LTD) having the same mass is used as the filler. A particulate flocculant DEV106 (available from Nalco (China) Environmental Protection Technology Service Co., LTD, silica sol, with a solid content of 15 wt %) is added before adding the flocculant DEV210, in an amount of 3 kg per ton of the filler. See Table 3 for the results.

Comparative Example 4

The method of Example 5 is used, and the difference lies in that flocculant DEV210 and particulate flocculant DEV106 are not added. See Table 3 for the results.

Example 6

The method of Example 1 is used, and the difference lies in that commercially available ultra-fine kaolin is used as the filler. See Table 3 for the results.

Example 7

The method of Example 1 is used, and the difference lies in that commercially available talcum powder (purchased from Dandong Medical Talcum Powder Factory, with a Product Mark of "白峰") is used as the filler. A particulate flocculant DEV106 is added before adding the flocculant DEV210, in an amount of 3 kg per ton of the filler. See Table 3 for the results.

Comparative Example 5

The method of Example 7 is used, and the difference lies in that flocculant DEV210 and particulate flocculant DEV106 are not added. See Table 3 for the results.

TABLE 3

| Number | Fillers Kg | Treating Agent kg | Span | D (0.1) | D (0.5) Micron | D (0.9) |
|---|---|---|---|---|---|---|
| Example 4 | GCC + PCC | DEV210 | 1.746 | 7.99 | 19.913 | 42.748 |
| Example 5 | GCC + Kaolin | DEV106 + DEV210 | 1.776 | 24.711 | 63.498 | 137.475 |
| Comparative Example 4 | GCC + Kaolin | — | 1.758 | 3.663 | 8.152 | 17.995 |
| Example 6 | Kaolin | DEV210 | 1.352 | 28.992 | 60.218 | 110.407 |
| Example 7 | Talcum Powder | DEV106 + DEV210 | 1.522 | 16.677 | 39.605 | 76.952 |
| Comparative Example 5 | Talcum Powder | — | 2.386 | 3.356 | 17.527 | 45.183 |

It can be seen from Table 3 that, the fillers treated by the method in the examples of the present invention have a larger median particle size and a smaller size distribution span as compared to the fillers without treatment. In addition, different fillers treated by the method in the examples of the present invention all have a relatively larger median particle size and a smaller size distribution span.

Example 8

The method of Example 1 is used, and the difference lies in that coagulant DEV110 (available from Nalco (China) Environmental Protection Technology Service Co., LTD, cationic polyacrylamide, with a molecular weight of 500,000) is added before adding flocculant DEV210, in an amount of 0.5 kg per ton of the filler. See Table 4 for the results.

Example 9

The method of Example 8 is used, and the difference lies in that particulate flocculant DEV106 is added after adding the coagulant DEV110 (in an amount of 0.5 kg per ton of the fillers) and before adding flocculant DEV210, in an amount of 3 kg per ton of the filler. See Table 4 for the results.

TABLE 4

| Example Number | Added Component | Span | D (0.1) | D (0.5) Micron | D (0.9) |
|---|---|---|---|---|---|
| 1 | DEV210 | 2.03 | 23.929 | 62.397 | 150.62 |
| 8 | DEV110 + DEV210 | 1.675 | 22.164 | 51.723 | 108.8 |
| 9 | DEV110 + DEV106 + DEV210 | 1.615 | 37.637 | 89.677 | 182.461 |

Data of Example 1 is listed in Table 4. It can be seen from Table 4 that, the filler treated by adding the coagulant DEV110 before adding the flocculant DEV210 can obtain a smaller size distribution span. The filler treated by further adding particulate flocculant DEV106 can have a larger median particle size.

Example 10

This example is used to demonstrate the feasibility that the method of the present invention can be used for a continuous process.

Centrifugal pump A (mainly for providing power) is used for pumping a mixture of GCC of 18 wt % and water into centrifugal pump B (mainly for mixing agents) at a flow rate of 40 L/min. 2 kg flocculant DEV210/ton (filler particles) is added at the inlet of the centrifugal pump B. And then sampling at the outlet of the centrifugal pump B, a laser particle analyzer is used to measure the particle size and the size distribution span of the filler particles. See Table 5 for the experimental results.

Example 11

The method of Example 10 is used, and the difference lies in that 1.5 kg particulate flocculant DEV106/ton (filler particles) is added to GCC slurry at the inlet of the centrifugal pump A. See Table 5 for the experimental results.

Comparative Example 6

The method of Example 10 is used, and the difference lies in that flocculant 7527 is used instead of DEV210. See Table 5 for the experimental results.

TABLE 5

| Number | Span | D (0.1) μm | D (0.5) μm | D (0.9) μm |
|---|---|---|---|---|
| Example 10 | 1.898 | 22.708 | 66.105 | 148.149 |
| Example 11 | 1.921 | 28.581 | 83.45 | 188.907 |
| Comparative Example 6 | 2.479 | 4.133 | 10.881 | 31.11 |

It can be seen from Table 5 that, when the method in the examples of the present invention is used for treating the fillers in a continuous process, the filler obtained by the treatment can still have a larger median particle size and a smaller size distribution span.

Example 12

The method of Example 10 is used, and the difference lies in that the flocculant is 61755. The above-mentioned rotating mixing apparatus is used instead of the centrifugal pump B. Moreover, the median particle size and size distribution span of filler particles are measured after sampling at the outlets of the rotating mixing apparatus, when the rotational frequency of the rotating mixing apparatus is 20 Hz and 30 Hz, respectively, and the solid content of GCC filler is 10 wt %, 15 wt %, 18 wt %, 20 wt % and 30 wt %, respectively.

The size distribution span is as shown in Table 6, and the median particle size of GCC filler with the solid contents of 10 wt % and 18 wt % is as shown in Table 7.

Example 13

The method of Example 12 is used, and the difference lies in that a static mixer (available from Nalco (China) Environmental Protection Technology Service Co., LTD) is used instead of the rotating mixing apparatus. The solid content of GCC filler is 10 wt %, 15 wt %, 18 wt %, 20 wt % and 30 wt % respectively.

Sampling at the outlet of the static mixer, the size distribution span obtained is as shown in Table 6, and the median particle size of GCC filler with the solid content of 10 wt % and 18 wt % is as shown in Table 7.

TABLE 6

| Span of Distribution | | | |
|---|---|---|---|
| GCC Solid Content of Fillers, % | Rotating Mixing Apparatus, 20 Hz | Rotating Mixing Apparatus, 30 Hz | Static Mixer |
| 15 | 1.22 | 1.12 | 1.88 |
| 20 | 1.2 | 1.06 | 1.79 |
| 30 | — | 1.53 | 2.34 |

TABLE 7

| Median Particle Size, μm | | |
|---|---|---|
| GCC Solid Content of Fillers, % | Rotating Mixing Apparatus, 20 Hz | Static Mixer |
| 10 | 32.2 | 22.9 |
| 18 | 39.4 | 36.9 |

It can be seen from Tables 6 and 7 that, the filler particles obtained by the pretreatment with the rotating mixing apparatus could have a smaller distribution span and a larger median particle size, compared with that obtained by pretreatment with the static mixer used in the prior art. Hence, using the rotating mixing apparatus is more conducive to increase the ash content of the paper product without losing the quality of the paper product, and also can reduce the production cost of the paper product obtained.

Testing Example 1

The purpose of this testing example is to evaluate the effect of the filler pretreatments using different flocculants on the change of the tensile strength of a handsheet paper with the ash content of paper. The tensile strength of paper is measured according to TAPPI T494.

The filler obtained in Example 1 is added to a slurry consisting of 60% hardwood blanched chemical pulp (HBKP), 20% softwood blanched chemical pulp (SBKP) and 20% bleached chemical thermo-mechanical pulp (BCTMP), with a solid content of approximately 0.7%. Weigh a certain amount of filler-containing slurry, stir at 800 rpm, add coagulant cationic starch (10 kg/ton paper), cationic flocculant 61067 (available from Nalco (China) Environmental Protection Technology Service Co., LTD, 200 ppm) and bentonite (1 kg/ton paper) every 15 seconds. The obtained paper sample is dried overnight under a constant temperature and humidity (23 degree Centigrade, 50% of humidity).

In addition, in the above papermaking process with the filler obtained in Example 1 being added, 30 kg dry strength agent 64170 (available from Nalco (China) Environmental Protection Technology Service Co., LTD) per ton of paper product is added to the papermaking wet end, after adding coagulant cationic starch (10 kg/ton paper) and before adding the cationic flocculant 61067 and bentonite in every 15 seconds. Furthermore, the same method as above is used, and the difference lies in that the fillers obtained in Comparative Example 1 and Comparative Example 3 are used, respectively.

The paper samples obtained are analyzed. The following results are shown in FIG. 1: filler is treated with DEV210 (Example 1), filler is treated with DEV210 and 30 kg/ton dry strength agent is added, filler is untreated (Comparative Example 3) and 30 kg/ton dry strength agent is added, filler is treated with 2 kg/ton 7527 (Comparative Example 1) and 30 kg/ton dry strength agent is added. FIG. 1 is a relation graph of the change of the tensile strength of paper with the ash content of paper under different filler pretreatments.

It can be seen from FIG. 1 that, as compared with the prior art technical scheme of filler pretreatment with 7527 and addition of 30 kg/ton dry strength agent, the filler pretreatment with DEV210 alone still makes the paper strength increased under the same ash content. Continue to add 30 kg/ton dry strength agent, the strength increases 16% under the same ash content as compared to paper product in the prior art. Since the filler treated with DEV210 has a larger particle size than the filler treated with 7527, the package of small fillers on the fiber surface is reduced after the fillers form a flocculant polymer having a certain size and narrower distribution, then more fiber surfaces are exposed during the formation of paper, such that the fibers have more opportunity and surface area to form a fiber-fiber combination. In addition, one of the main sources for paper strength is the fiber-fiber combination strength, therefore the tensile strength of paper is significantly increased.

Testing Example 2

The purpose of this testing example is to evaluate the effects of the filler pretreatment with DEV210 flocculant and the preflocculation fillers treated by U.S. Pat. No. 8,088,213 B2 on the internal bonding strength of a handsheet paper sheet. The internal bonding strength is measured according to executive standard TAPPI T-569. The cohesion strength is obtained by measuring and calculating Scott bond strength of the paper.

The fillers obtained in Example 1, Comparative Example 2 and Comparative Example 3 are added to a slurry consisting of 60% hardwood blanched chemical pulp (HBKP), 20% softwood blanched chemical pulp (SBKP) and 20% bleached chemical thermo-mechanical pulp (BCTMP), with a solid content of approximately 0.7%. Weigh an amount of filler-containing slurry, stir at 800 rpm, add coagulant cationic starch (10 kg/ton paper), cationic flocculant 61067 (available from Nalco (China) Environmental Protection Technology Service Co., LTD, 200 ppm) and bentonite (1 kg/ton paper) every 15 seconds. The obtained paper sample is dried overnight under a constant temperature and humidity (23 degree Centigrade, 50% of humidity).

In addition, in the above papermaking processes added with the fillers obtained in Example 1, Comparative Example 2 and Comparative Example 3, 30 kg dry strength agent 64170 (available from Nalco (China) Environmental Protection Technology Service Co., LTD) per ton of paper product is added to the papermaking wet end, after adding coagulant cationic starch (10 kg/ton paper) and before adding the cationic flocculant 61067 and bentonite in every 15 seconds.

Figure 2:
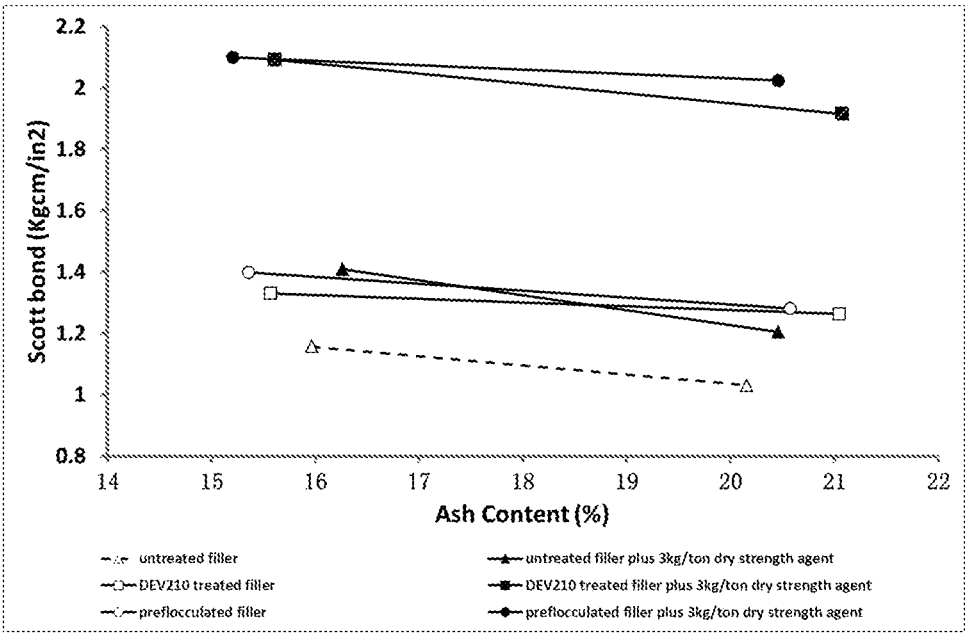
FIG. 2 shows the comparative testing results of Scott bond strength associated with ash content in the paper products obtained from the papermaking process in another embodiment of the present invention and the papermaking process in the relevant techniques.

The paper samples obtained are analyzed. The following results are shown in FIG. 2: filler is treated with DEV210 (Example 1), filler is treated with DEV210 and 30 kg/ton dry strength agent is added, filler is untreated (Comparative Example 3), filler is untreated and 30 kg/ton dry strength agent is added and then filler is treated by pretreatment technique (Comparative Example 2), the filler is treated by pretreatment technique and 30 kg/ton dry strength agent is added. FIG. 2 is a relation graph of the change of the cohesion strength of paper with the ash content of a paper under different filler pretreatments.

It can be seen from FIG. 2 that, as compared to the filler treated by preflocculation technique or the untreated filler (and adding 30 kg dry strength agent 64170/ton (paper product) to papermaking wet end), in the case where the flocculant of the examples of present application is added alone, the strength of the paper is comparative. In addition, as compared to the filler treated by preflocculation technique (and adding 30 kg dry strength Agent 64170/tun (paper product) to papermaking wet end), the fillers treated by the flocculant of the examples of present application (and adding 30 kg dry strength agent 64170/ton (paper product) to papermaking wet end) also can obtain a paper having comparative strength. However, the process of the present application can achieve filler preflocculation effect by use of only one kind of flocculant, which reduces the chemical disposition and treatment cost, and thus can effectively reduce the production cost of papers.

The composition, operation and disposition in the process of the examples of the present invention herein could vary without departing from the principle and scope of the present invention as defined, for example, in the claims. While the present invention may be embodied in many different forms, there are described in detail herein some embodiments of the present invention. The present disclosure is an exemplification of the principles of the present invention and is not intended to limit the present invention to the particular embodiments illustrated. Furthermore, the present invention encompasses any and all possible combinations of some or all of the various embodiments described herein. Any and all patents, patent applications and other references recited in the present application or in any recited patent, any recited patent application or other cited data are hereby incorporated herein by reference in their entirety.

The above disclosure is intended to be illustrative and not exhaustive. This description will suggest many variations and alternatives to a person skilled in the art. All these alternatives and variations are intended to be included within the scope of the claims where the term "comprising" means "including, but not limit to". A person skilled in the art may recognize other equivalents to the specific embodiments described herein which equivalents are also intended to be encompassed by the claims.

Here is the description of the alternative embodiments of the present invention made. A person skilled in the art may recognize other equivalents to the specific embodiments described herein which equivalents are also intended to be encompassed by the attached claims.

The invention claimed is:

1. A process for flocculating filler particles in water comprising:

adding an acrylamide-based polymer flocculant to a mixture comprising filler particles and water, wherein the acrylamide-based polymer flocculant has a reduced specific viscosity ("RSV") of from about 5 dL/g to about 12 dL/g, a viscosity average molecular weight of from about 1,400,000 to about 5,000,000, and a cationic charge of from about 20 mol % to about 40 mol %;

wherein the acrylamide-based polymer flocculant is the only flocculant added to the mixture comprising filler particles and water;

wherein flocs formed by flocculation of the filler particles and the acrylamide-based polymer flocculant have a median particle size of from about 10 μm to about 150 μm;

wherein the filler is not precipitated calcium carbonate alone.

2. The process of claim 1, wherein the median particle size of the flocs formed by flocculation of the filler particles and the acrylamide-based polymer flocculant is from about 30 μm to about 120 μm.

3. The process of claim 1, wherein the flocs have a size distribution, and the size distribution spans less than 2 μm.

4. The process of claim 1, wherein an amount of the acrylamide-based polymer flocculant added to the mixture is from about 0.2 kg to about 4 kg per ton of the filler particles.

5. The process of claim 1, wherein the acrylamide-based polymer flocculant is a polymer formed by acrylamide and one or more monomers selected from acryloyloxyethyl trimethyl ammonium chloride, dimethylaminoethyl methacrylate, dimethylaminoethyl acrylate, diethylaminoethyl acrylate, diethylaminoethyl methacrylate, diallyldimethylammonium chloride, and quaternary ammonium salt formed of dimethyl sulfate and methyl chloride or benzyl chloride.

6. The process of claim 5, wherein the polymer is a copolymer or terpolymer formed by two or more of the monomers.

7. The process of claim 6, wherein the acrylamide-based polymer flocculant is a copolymer of acrylamide and acryloyloxyethyl trimethyl ammonium chloride, and/or a copolymer of acrylamide and diallyldimethylammonium chloride.

8. The process of claim 1, wherein the filler is one or more materials selected from a group of calcium carbonate, kaolin, titanium dioxide, talcum powder, silica, silicate, aluminum hydroxide, barium sulfate and calcium sulfate; wherein, when the filler is calcium carbonate, the filler particles comprise at least 10 wt % ground calcium carbonate.

9. The process of claim 1, wherein the mixture comprising the filler particles and water is an aqueous dispersion of the filler particles.

10. The process of claim 1, wherein the acrylamide-based polymer flocculant is added to the mixture with a rotating mixing apparatus having a distribution head rotated by a driver, the distribution head arranged in a container containing an aqueous slurry of the filler particles and has a rotation plane associated with the rotation thereof, and the distribution head has, along a circumference, which surrounds a rotation axis, distributed outlets and mixing blades, the acrylamide-based polymer flocculant is passed from the outlets into the slurry, the outlets are formed as openings, the mixing blades are formed as strips extending transverse to the rotation plane, having a length equal to at least half of an inner diameter of a slurry pipe.

11. The process of claim 1, wherein the acrylamide-based polymer flocculant has a RSV of from about 9 dL/g to about 11 dL/g.

12. The process of claim 1, wherein the acrylamide-based polymer flocculant has a viscosity average molecular weight of from about 3,300,000 to about 4,400,000.

13. The process of claim 1, further comprising adding the flocs to a papermaking wet end.

14. The process of claim 13, further comprising:

adding an enhancer selected from starch and a modified substance thereof, chitosan, guar gum, hydroxymethyl cellulose, formaldehyde resin, polyethyleneimine, polyvinyl alcohol, or a combination thereof to the papermaking wet end.

* * * * *